US005556199A

United States Patent [19]

Oswald

[11] Patent Number: 5,556,199

[45] Date of Patent: Sep. 17, 1996

[54] VIBRATOR WITH COVERING AND RELATED METHOD

[76] Inventor: Fred Oswald, 65 Channel Dr., Port Washington, N.Y. 11050

[21] Appl. No.: 355,964

[22] Filed: Dec. 14, 1994

[51] Int. Cl.[6] ..... B01F 11/00

[52] U.S. Cl. ..... 366/120; 366/123

[58] Field of Search ..... 366/120–123, 366/128, 117; 138/172, 174, 121, 177

[56] References Cited

U.S. PATENT DOCUMENTS

| | | | |
|---|---|---|---|
| Re. 21,684 | 1/1941 | Mall | 259/1 |
| 1,989,409 | 5/1932 | Gordon | 25/1 |
| 2,492,431 | 12/1949 | Kroeckel | 259/1 |
| 2,597,505 | 5/1952 | Lindvrist | 259/1 |
| 2,603,459 | 7/1952 | McCrery | 259/1 |
| 2,705,618 | 4/1955 | Wyzenbeck | 259/1 |
| 3,042,386 | 7/1962 | Wyzenbeck | 259/1 |
| 3,109,461 | 11/1963 | Wolff et al. | 138/137 |
| 3,119,275 | 1/1964 | Ambrose | 74/61 |
| 4,196,755 | 4/1980 | Kutnyak et al. | 138/150 |
| 4,295,496 | 10/1981 | Bixby | 138/122 |
| 5,108,189 | 4/1992 | Oswald | 366/123 |

*Primary Examiner*—David Scherbel
*Assistant Examiner*—Patrick F. Brinson
*Attorney, Agent, or Firm*—Ladas & Parry

[57] ABSTRACT

A vibrator for immersion in wet concrete includes a relatively rigid shell with an internal vibrating mechanism. A cover is provided on the shell formed of a material softer than the shell whereby to lessen the effects of the impact of the shell on any encountered object such as a reinforcing rod. The cover is made, for example, of a plurality of rings arranged in axial series defining passages therebetween to provide access to the shell for cooling the same. The covering on the shell is intended to avoid chipping of, for example, epoxy coatings which are employed on reinforcing rods. As an alternative to the rings the covering can be formed with holes to provide passages for the cooling. The passages flare outwardly and are devoid of undercuts and recess to avoid entrapping cured and hardened concrete. A method can be employed of forming fins on the shell by which the cover is firmly attached to the shell, being molded thereupon.

8 Claims, 2 Drawing Sheets

VIBRATOR WITH COVERING AND RELATED METHOD

FIELD OF THE INVENTION

This invention relates to vibrators and more particularly to vibrators for use with concrete and the like. The invention also relates to associated methods.

BACKGROUND OF THE INVENTION

The pouring of low slump concrete into forms to build sidewalks, patios, roads, ramps, bridges, and the like is well known. It is also known to reinforce low slump concrete by the use of reinforcing rods made of steel or the like, the rods being placed into the forms prior to the pouring of the concrete and being held in elevated altitude in the forms by plastic inserts or such so that the rods are ultimately embedded in the set concrete.

It is further known to vibrate the concrete by inserting into or placing onto the concrete, before it has set, a mechanical vibrator. The function of the vibrator is to vibrate the concrete so that air and voids are eliminated therefrom to avoid the formation of undesirable pockets or honeycombs in the hardened concrete.

It has been found than, after a number of years, reinforcing rods may corrode thus weakening the thusly formed construction. This will especially happen under, for example, conditions whereby salt is spread in the winter to prevent the formation of ice. It will also happen due to the prevalence of acid rain and in ocean front structures, and so forth. To avoid the corrosion of reinforcing rods, they have been coated with a non-corrosive coating such as 0.005 to 0.010 inches of epoxy to shield them from the action of corrosive substances. This coating is frequently destroyed or marred upon being contacted by a vibrator which is being used as indicated above.

In my earlier U.S. Pat. No. 5,108,189 is disclosed a vibrator which includes a relatively rigid shell having therein a vibrating mechanism to enable the vibrator to vibrate. The shell in said patent is provided with a cover which is formed of a material softer than the shell to lessen the effect of the impact of the shell on rigid objects encountered by the vibrator. Such rigid objects may be, for example, reinforcing rods covered with an epoxy the chipping of which is to be avoided. The preferred form of the vibrator of said patent provided passages through which wet concrete could find access to the shell to remove heat therefrom. More particularly, an undercut in such passages was provided in order to expose an increased area of the shell to the cooling effect of the wet concrete.

It has now been found that, in certain circumstances and between sequential uses of a vibrator of the aforenoted type, some of the wet concrete will be cured and thus will harden. The hardened concrete may be undesirably retained in the passages which otherwise advantageously provide access to the shell for cooling purposes.

SUMMARY OF THE INVENTION

It is an object of the invention to provide improvement with respect to the structure disclosed in my earlier U.S. Pat. No. 5,108,189.

It is a further object of the invention to provide improvements which avoid the retention of hardened concrete in and on vibrators having provisions for cooling the internal shell of the vibrator structure.

Still another object of the invention is to provide methods for enhancing the retention of covers on the inner structures of vibrators of the invention.

In achieving the above and other objects of the invention in accordance with one view thereof, there is provided a vibrator which includes a vibrating means for vibrating an at least partly fluid mass, such as wet concrete, and wherein heat is generated incidental to the generation of vibration, said mass including matter adapted to harden upon being cured. Further provided is a covering on the vibrating means which is of a material to minimize shock upon relatively rigid structures when encountered within the fluid mass. This covering defines passages distributed along the vibrating means, as is known, to permit access thereto by the fluid mass to cool the vibrating means. These passages, at least in part and in accordance with the invention, flare outwardly commencing at and away from the vibrating means. The passages are further devoid of undercuts and recesses whereby to avoid the retention of hardened matter.

As will be explained hereinafter, the flaring of the passages is preferably above 0 degrees and less than 45 degrees relative to a radial plane passing through the vibrating means. More particularly, the flaring will preferably be in the order of magnitude of about 5 degrees. According to the invention, at least 5% and up to, for example, 50% of the shell is exposed by the passages, the preferred range laying between 10 and 25%.

According to another view of the invention, there is provided a vibrator comprising a relatively rigid shell, vibratable means within the shell to cause the same to vibrate and cover means on the shell of a material softer than the shell. The cover means defines at least one opening providing access to the shell for cooling the same, this opening expanding at least in part outwardly away from and commencing at the shell and being free of undercuts and constrictions. The opening may be in the form of annular slot, in which event the covering means includes spaced walls defining the annular slot, at least one of the walls sloping at least in part away from the other of the walls commencing at the shell.

In another form, the covering means may define a plurality of openings which may be circular or elongated or possibly of other shapes. These openings will be, for example, of conical or truncated conical form in order to afford access to the shell and to provide for avoiding the retention of hardened material. In one preferred form, at least some of the openings may be elongated transversely of the shell which is cylindrical and will expand outwardly away from the shell. In another preferred form, the shell is elongated and at least some of the opening are elongated longitudinally along the shell and expand outwardly away from the shell.

According to further features of the invention, a method is provided whereby fins or protrusions are formed on the shell, the cover being molded directly on the shell and retained thereon by the fins.

The above and other objects, features and advantages of the invention will be found in the detailed description which follows as illustrated in the accompanying drawing.

DETAILED DESCRIPTION

As has been mentioned in my earlier patent (U.S. Pat. No. 5,108,189) it is possible for the steel head or shell of a conventional vibrator to strike reinforcing rods which are in many cases provided with an epoxy coating or the like. This results in damages such as a cracking or chipping of the epoxy, thus exposing the steel to the corrosive effects of acid rain, water in which salt has been dissolved, and the like. In accordance with the aforesaid patent, a general solution is to cover the steel vibrating shell with a material which is softer than the epoxy on the rods to be impacted or encountered. However, a generalization of this problem is to avoid distressing or ruining objects or various types of coatings on any type of object which may be encountered especially in a setting concrete environment.

A particular problem is that the eccentric rotor, accommodated in the vibrator shell, generally rotates at a relatively high speed such as, for example, 10,000–15,000 r.p.m. This generates a substantial amount of heat in the ball bearings and seals which are employed within the vibrator shell. To minimize this problem, provision is made for maximizing the contact of the wet concrete with the vibrator shell thereby to cool the unit. The use of any soft non-conductive covering, however, insulates the vibrator and tends to allow the temperature to rise above safe limits which, for example, may be regarded as being of the order of magnitude of approximately 350° F. To avoid this result, the cover for the vibrator shell is provided with passages as will be described in greater detail hereinbelow to permit the contact of the wet concrete with the vibrator shell thereby to provide for cooling.

Figure 1:
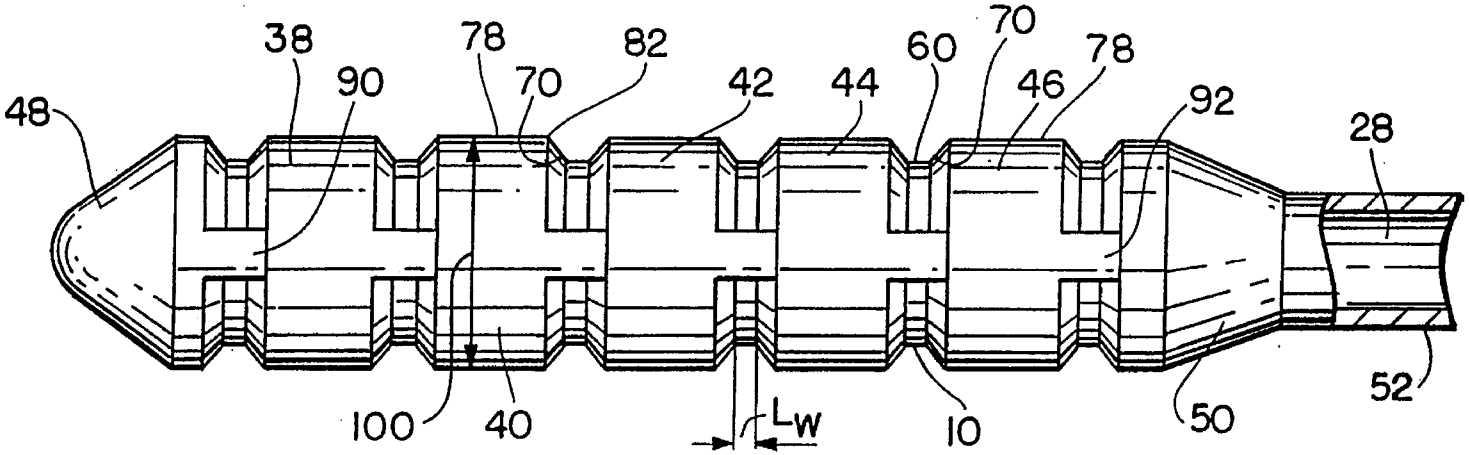
FIG. 1 is a side view of a vibrator provided in accordance with one embodiment of the invention.

More specifically, the vibrator of the invention is provided with a relatively soft cover made of relatively resilient material. The material is softer than the objects or object coatings which may be encountered and is softer than the internal vibrator shell. One such cover is illustrated in FIG. 1, wherein appears an axial series of rings 38, 40, 42, 44 and 46. Also provided are a soft molded nose piece 48 and a transition piece 50 enabling an accommodation of the relatively smaller diameter of a flexible shaft which, as shown, is covered by a tube 52 at the extremity of the shaft which is attached to the vibrator.

Figure 3:
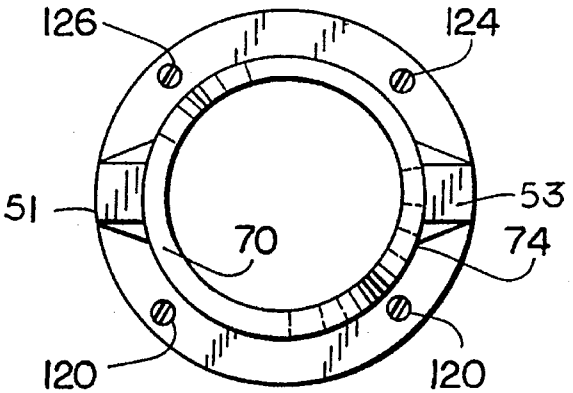
FIG. 3 is an end view of the element shown in FIG. 2.
Figure 2:
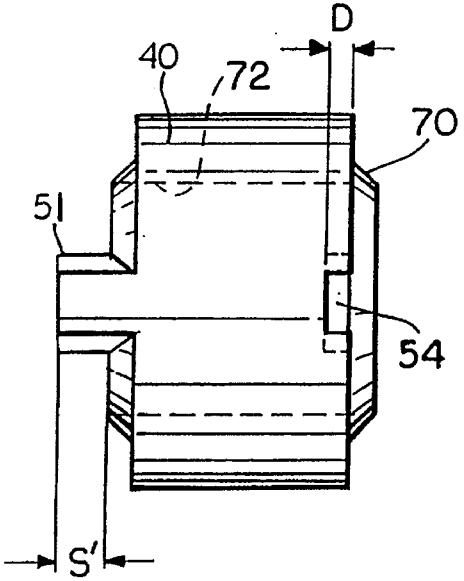
FIG. 2 is a side view of an element of the covering of the vibrator of FIG. 1 in slightly modified form.

As appears more particularly in FIGS. 2 and 3, each ring, for example, the ring 40 is provided with a pair of projections 51 and 53, whose axial extent is indicated at S. Each ring is moreover provided with a pair of notches or receptacles such as indicated at 54. The axial extent of these notches is indicated at D. The axial extent of the projections is greater than the axial extent D of the receptacles so that the rings are spaced from each other to form passages such as indicated at 60 in FIG. 1. These passages enable the surrounding concrete (still in fluid form) to make contact with the interior shell 10, thereby to make use of the cooling effect of the wet concrete for purposes of removing heat such as generated in the bearings (not shown) during the operation of the device. Vibration may be effected as shown in U.S. Pat. No. 5,108,189. The width of passages 60 is indicated at W in FIG. 1 which, for example, may be in the range of 0.100 to 0.2500 inches as required.

As will be noted in FIG. 1, the conical nose 48 is provided with its own projection 90, whereas transition piece 50 is provided with its own receptacle 92, this enables these pieces to be included in the axial series which cooperatively encircles and covers the shell 10, thereby to minimize the effect of impact with encountered objects such as the epoxy-coated steel reinforcing rods referred to hereinabove.

To overcome certain destructive effects which the vibrating force may have on the aforementioned rings, each ring may be provided with a plurality of reinforcing elements such as the axially aligned braids or rods indicated in FIG. 3 at 120, 122, 124, and 126. These reinforcements, which may be fabricated of metal, may also be accompanied or substituted for by means of metal rims or the like. In addition to being disposed in axial attitude as illustrated in FIG. 3, these inserts may also be formed as rings which circle through the bodies of the rings. Any configuration of these rings may be employed in accordance with the invention.

The cover rings of the invention which can be made of tire quality rubber may be reinforced as indicated above. They can particularly be formed of styrene butadiene. In addition thereto, or perhaps in substitution of reinforcement, a special mixture may be substituted for rubber. One possible substitution for rubber is a mixture of "Kevlar" available from DuPont and urethane, which mixture has a relatively high tensile strength. This blend can be used by itself to improve the tensile strength of the rings or may be used in association with the type of insert which has been indicated hereinabove.

From what has been described above, it is seen that a preferred embodiment of the invention involves the use of a relatively rigid vibratable shell with a flexible shaft coupled to the vibrator to drive the same, there being provided a cover of a material softer than the shell whereby to lessen the effect of impact of the shell on any encountered object.

In accordance with the invention, the material from which the rings or covering are made will be abrasion resistant and of relatively high tensile strength with minimized heat distortion. The rings may be made from the materials indicated above and will preferably have, for example, a Shore hardness of the order of magnitude of 60 on the A scale or 16 on the D scale.

As a feature of the method of the invention to be developed further below, there is provided a cooling of the vibrator by forming passages in the covering so that the concrete can contact the vibrator to make use of the cooling effect of the wet concrete while avoiding the retention of hardened concrete therein.

To avoid the retention of hardened concrete as may accumulate in passages 60 (FIG. 1) between uses of the vibrator, the passages 60 may be specially configured in accordance with the invention. More particularly, the passages 60 may be flared in the form of ramps 70 flaring out directly from bore 72 (FIG. 2) passing through the rings. FIG. 2 illustrates, moreover, that (as distinguished from FIG. 1) the ramps 70 which constitute truncated cones need not go completely to the outer surfaces of the rings but can instead terminate at planar radial surfaces 74. The cumulative effect which is desired is that the passages 60 will be devoid of undercuts or constrictions or recesses which may entrap hardened concrete. Thus, the passages will be bound by walls which are at least partly in the form of ramps and perhaps also partly of planar radial walls. These ramps will start at surfaces 72 (and thus effectively at the outer surface of shell 10).

Figure 4:
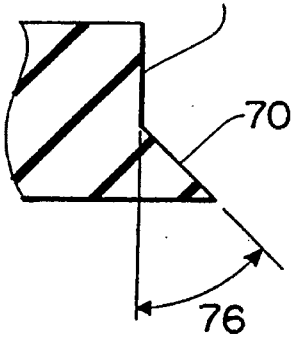
FIG. 4 is a view of a fragmentary portion of the element of FIG. 2 illustrating certain details thereof.

Planar radial wall 74 and ramp 70 are shown on enlarged scale in FIG. 4. The angle therebetween is indicated at 76. This angle will be greater than zero degrees and preferably less than forty-five degrees. Advantageously, angle 76 will be greater than five degrees. The ramp 70 can in some configurations terminate at the outer surface 78 (as shown in FIG. 1) in which event the angle 76 will apply to an imaginary radial plane corresponding to edge 82 between the surface 78 and ramp 70.

Figure 5:
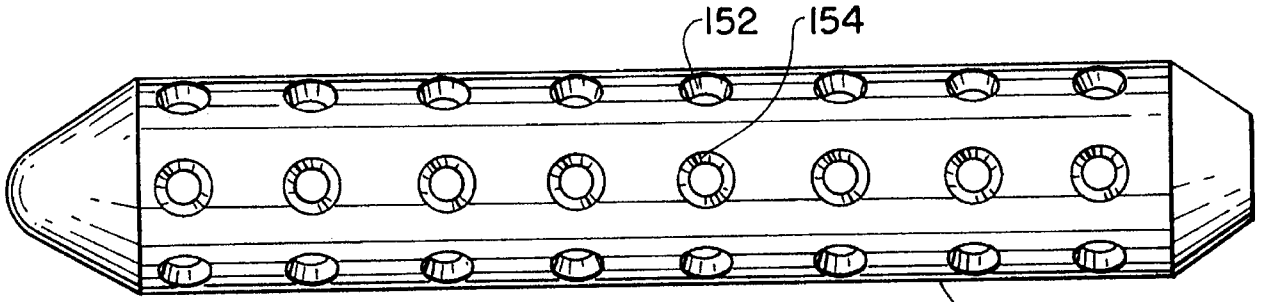
FIG. 5 is a side view of a covering provided in accordance with another embodiment of the invention.

FIG. 5 illustrates diagrammatically a cover 150 having a plurality of holes 152 the sloped walls of which are indicated at 154. The holes 152 in this embodiment are elongated in the embodiment of FIG. 6 in the longitudinal direction indicated by the axis of symmetry 166 of the cover. In this embodiment, the sloped walls 164 of elongated holes 162 of cover 160 are devoid of undercuts or recesses thereby avoiding the retention of hardened concrete or the like which may be formed between sequential uses of the associated vibrator.

Figure 7:
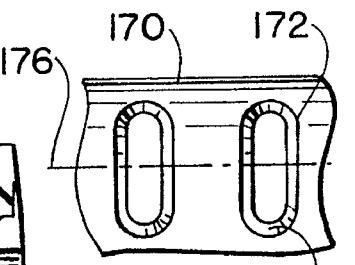
FIG. 7 illustrates a further modification corresponding to the view in FIG. 6.

FIG. 7 illustrates a cover 170 having therein holes 172, the sloped walls of which are indicated at 174. In this embodiment, the holes are elongated transversely of the axis of symmetry 176. In this embodiment also, the wall are devoid of undercuts, recesses and the like which might entrap hardened concrete between sequential uses of the vibrator.

Figure 6:
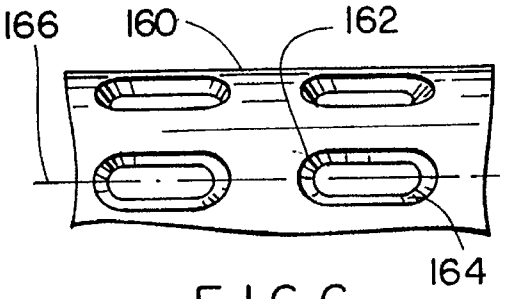
FIG. 6 is a broken away view of a portion of a covering constituting a modification of the structure shown in FIG. 4.

In the embodiments of FIGS. 5–7, the angle of slope of the ramps or walls of the various openings or passages conform with the limitations set forth hereinabove as to angle of slope.

Figure 8:
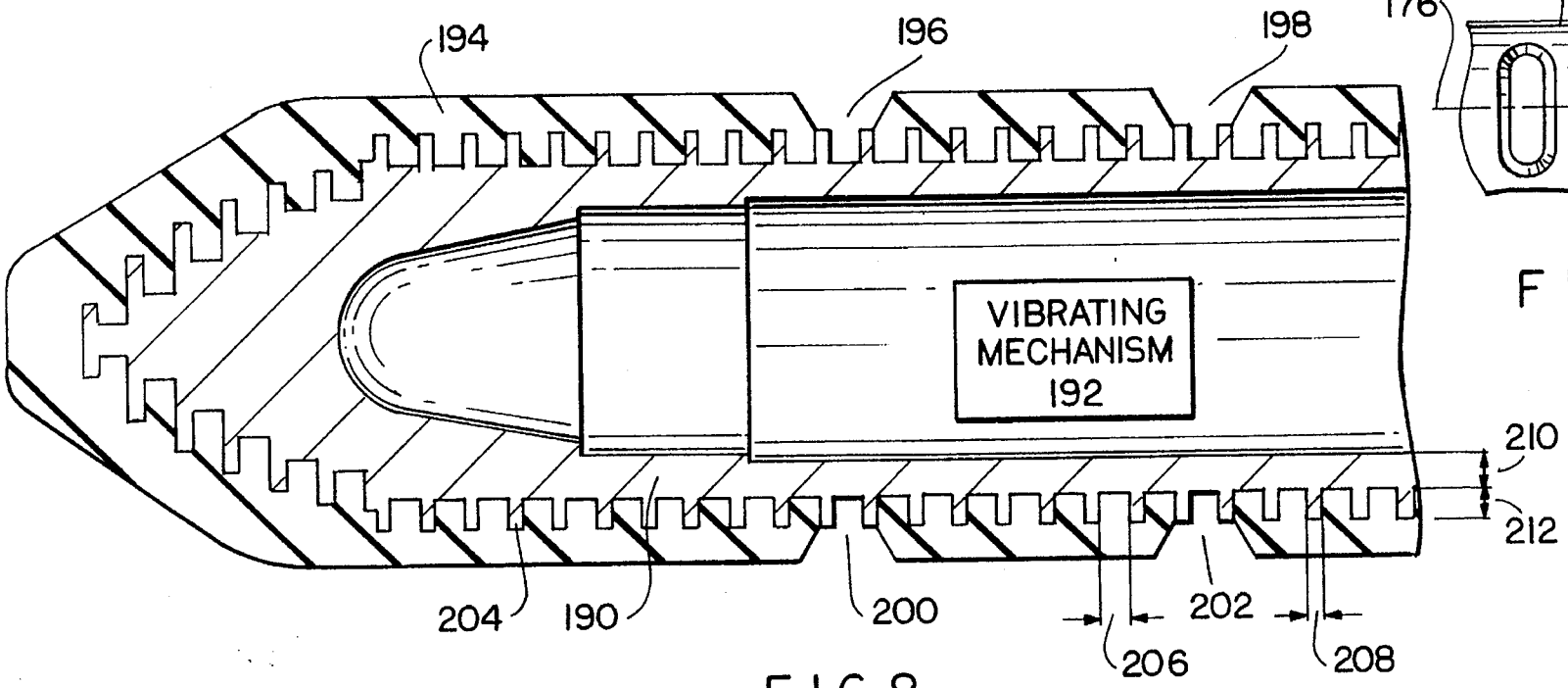
FIG. 8 is a fragmentary side sectional view, partly diagrammatic, illustrating a constructional feature of the invention as well as a method thereof.

FIG. 8 is a side cross sectional view of a vibrator provided in accordance with the invention incorporating features relating to the connection of a cover to a shell and illustrative of a method of the invention.

More particularly illustrated in FIG. 8 is a rigid shell 190 fabricated of steel or aluminum and internally accommodating a vibrating mechanism 192 such as illustrated in my earlier U.S. Pat. No. 5,108,189. Other types of vibrating mechanisms can also be employed.

In this embodiment of the invention there is provided a coating or covering 194 which is of a material having the characteristics described hereinabove with respect to other embodiments of the invention. In this covering are provided openings or passages such as indicated at 196, 198, 200 and 202. As in the above described embodiments these passages are intended to provide access to the shell for a cooling medium such as wet concrete.

In accordance with the invention, there is provided a method and structure whereby fins 204 are provided in serial array on the exterior of the shell 190. The covering 194 is molded directly onto the shell being thus bonded thereto and engaging particularly with the fins 204 so as to enhance the connection between the cover and the shell. Thus there is assurance that the cover can not become detached from the shell despite relatively large magnitudes of vibration imparted to the shell.

The fins are preferably uniformally spaced longitudinally along the shell and are preferably of a uniform height. The fins may be omitted at certain positions to provide for passages such as have been mentioned hereinabove. Preferably the fins are spaced apart by a dimension indicated at 206 which are of an order of magnitude of one-eighth to three-eighths of an inch. Other spacings may be provided to accommodate special arrangements. The fins themselves have preferably a uniform thickness such as indicated at 208. This thickness is within the range of one-sixteenth to three-eighths of an inch. Similarly, this range can be exceeded where required such as for example to accommodate the molding onto the shell of various special types of coatings. The thickness of the shell over the major longitudinal extent thereof is indicated at 210. This radial thickness is preferably in the order of a magnitude of one-eighth to three-eighths of an inch, although other radial thicknesses can be employed within the scope of the invention. The height of the fins is preferably uniform being indicated at 212. This size is preferably is in the same order of magnitude as the thickness 210 of the associated shell being, for example, in an order of magnitude of about one-eighth to three-eighths of an inch.

The method of the invention is as indicated above inclusive of molding of the relatively soft and resilient coating 194 to the relatively rigid shell 190, so that the coating in effect is bonded to the shell itself. Relative movement of the coating relative to the shell and detachment of the coating from the shell is avoided by the provision of the aforesaid fins, while at the same time a cooling of the shell is afforded by the provision of openings or passages as has been described hereinabove.

While this embodiment of the invention has particular application to what has been described herein relative to FIGS. 5–7 it will be obvious that the utilization of fins or protrusions which result in a more intimate and guaranteed connection between the coating and the shell would also be applicable to other versions of the invention such as for example, appears in FIGS. 1–4.

There will now be obvious to those skilled in the art many modifications and variations of the structures set forth hereinabove. These modifications and variations will not depart from the scope of the invention if defined by the following claims.

What is claimed is:

1. A vibrator comprising a relatively rigid vibratable shell, and covering means on the shell and of a material softer than the shell, said covering means defining a plurality of openings providing access to the shell for cooling the same, said openings expanding at least in part outwardly commencing at the shell and being free of undercuts and constrictions, the openings being conical.

2. A vibrator comprising a relatively rigid vibratable shell, and covering means on the shell and of a material softer than the shell, said covering means defining a plurality of openings providing access to the shell for cooling the same, said openings expanding at least in part outwardly commencing at the shell and being free of undercuts and constrictions, the shell being elongated and at least some of the openings being elongated longitudinally along the shell and expanding outwardly away from the shell.

3. A vibrator comprising a vibrating means for vibrating an at least partly fluid mass, and wherein heat is generated incidental to the generation of vibration, said mass including matter adapted to harden upon being cured, and a covering means on the vibrating means and of a material to minimize shock on relatively rigid structures when encountered within said mass, said covering means defining passages distributed along said vibrating means to permit access to the vibrating means by the fluid mass to cool the vibrating means, said passages at least in part flaring outwardly commencing at and away from the vibrating means and being devoid of undercuts and recesses whereby to avoid the retention of hardened matter within said passages, the flaring being greater than about five degrees.

4. A vibrator comprising a vibrating means for vibrating an at least partly fluid mass, and wherein heat is generated incidental to the generation of vibration, said mass including matter adapted to harden upon being cured, and a covering means on the vibrating means and of a material to minimize shock on relatively rigid structures when encountered within said mass, said covering means defining passages distributed along said vibrating means to permit access to the vibrating means by the fluid mass to cool the vibrating means, said passages at least in part flaring outwardly commencing at and away from the vibrating means and being devoid of undercuts and recesses whereby to avoid the retention of hardened matter within said passages, the vibrating means including a metallic outer shell which is partly exposed to the fluid mass by said passages, said vibrator further comprising protrusions on the shell, said material being bonded to the shell and to said protrusions.

5. A vibrator as claimed in claim 4, wherein the shell is an elongated cylinder and the protrusions are parallel fins longitudinally spaced along the shell, said shell having a radial thickness one-eighth to three-eighths of an inch and the fins having a radial extent generally corresponding to said thickness.

6. A vibrator as claimed in claim 5, wherein said fins have a thickness of about one-sixteenth to three-eighths of an inch and are spaced at about one-eighth to three-eighths of an inch.

7. A method of manufacturing a vibrator comprising forming a cylindrical shell adapted to enclose a vibrating mechanism, forming external protrusions on the shell, molding on the shell in engagement with the protrusions a cover of a material softer than the shell and provided with openings exposing corresponding portions of the shell.

8. A method as claimed in claim 7, wherein the protrusions are formed as a series of spaced parallel fins.

* * * * *